US009820558B1

(12) United States Patent
de Geus

(10) Patent No.: US 9,820,558 B1
(45) Date of Patent: Nov. 21, 2017

(54) COMBINED CARRIERS AND PROTECTIVE VESTS

(71) Applicant: LEATHERBACK GEAR, LLC, Costa Mesa, CA (US)

(72) Inventor: Michael de Geus, Valencia, CA (US)

(73) Assignee: Leatherback Gear, LLC, Costa Mesa, CA (US)

( * ) Notice: Subject to any disclaimer, the term of this patent is extended or adjusted under 35 U.S.C. 154(b) by 0 days.

(21) Appl. No.: 15/232,548

(22) Filed: Aug. 9, 2016

(51) Int. Cl.

| | |
|---|---|
| ***A45F 4/02*** | (2006.01) |
| ***A41D 1/04*** | (2006.01) |
| ***A45F 3/04*** | (2006.01) |
| ***F41H 1/02*** | (2006.01) |

(52) U.S. Cl.
CPC ..... *A45F 4/02* (2013.01); *A41D 1/04* (2013.01); *A45F 3/04* (2013.01); *F41H 1/02* (2013.01)

(58) Field of Classification Search
CPC ..... A45F 4/02; A45F 3/04; A41D 1/04; F41H 1/02
See application file for complete search history.

(56) References Cited

U.S. PATENT DOCUMENTS

| | | | |
|---|---|---|---|
| 6,419,132 | B1 | 7/2002 | Reed et al. |
| 6,685,071 | B2 | 2/2004 | Prather |
| 7,441,278 | B2 | 10/2008 | Blakeley |
| 8,181,834 | B1 | 5/2012 | Howell |
| 9,044,074 | B1 | 6/2015 | De Freitas et al. |
| 2007/0295772 | A1 | 12/2007 | Woodmansee |
| 2008/0010730 | A1 | 1/2008 | Twito et al. |
| 2009/0014490 | A1 | 1/2009 | Bradley |
| 2009/0272773 | A1 | 11/2009 | Andrade |
| 2015/0196077 | A1* | 7/2015 | McIntire, Jr. ..... A41D 15/04 2/2.5 |

FOREIGN PATENT DOCUMENTS

| | | | |
|---|---|---|---|
| CN | 103115526 | A | 5/2013 |

OTHER PUBLICATIONS

Shield Pack NIJ IIIA Rated Bulletproof School Backpack [online] [retrieved Aug. 3, 2016]. Retrieved from the Internet <https://www.amazon.com/Shield-Pack-Bulletproof-School-Backpack/dp/B00DZX1QUM/ref=sr_1_3?ie=UTF8&qid=1470261262&sr=8-3&keywords=shield+pack+nij+iiia>, 5 pages.
EMS Bags by Meret, Home page [online] [retrieved Mar. 21, 2017]. Retrieved from the Internet <https://www.meretusa.com/>, 9 pages.
(Continued)

*Primary Examiner* — Corey Skurdal
(74) *Attorney, Agent, or Firm* — Bryan Cave LLP

(57) ABSTRACT

Bags or carriers are provided that can be transformed into protective vests and used as body armor and ballistic shields. The carriers can be assembled in a first arrangement that enables individuals to store and transport items. The carriers can quickly and easily be converted to or deployed in a second arrangement which enables the individuals to wear the carriers as protective vests. One or more shoulder straps can be detached from the carriers for use as tourniquets, doorway securing structures, and tools for dragging injured victims.

20 Claims, 6 Drawing Sheets

(56) References Cited

OTHER PUBLICATIONS

Omni Pro BLS/ALS Total System w/ M4L Ballistic Armored Protection, [online] [retrieved Mar. 21, 2017]. Retrieved from be Internet <https://www.meretusa.com/product.php?product_id=875>, 2 pages.
Savior7 Pro Combat Trauma System w/ M4L Ballistic Armored Protection, [online] [retrieved Mar. 21, 2017]. Retrieved from the Internet <https://www.meretusa.com/product.php?product_id=873>, 2 pages.
Defender Pro Commuter Backpack w/ M4L Ballistic Armored Protection. [online] [retrieved Mar. 21, 2017]. Retrieved from the Internet <https://www.meretusa.com/product.php?product_id=872>, 2 pages.

* cited by examiner

COMBINED CARRIERS AND PROTECTIVE VESTS

FIELD OF THE INVENTION

The present disclosure is directed to accessories that can be utilized for protection and, more particularly, to bags or other carriers that can be transformed into protective vests which can be worn as body armor or ballistic shields and which are equipped with tools that provide assistance in dangerous situations.

BACKGROUND

Bulletproof vests are used to protect individuals from projectiles (e.g., such as bullets from a gun or shrapnel from an explosion), stab wounds and other forms of harm. These vests include plated or non-plated armor regions which may cover an individual's torso, back and side areas in order to protect the individual's vital organs. The vests are most commonly worn by military or police personnel prior to engaging in dangerous or potentially dangerous situations.

Because the vests are designed for military or police personnel, the vests tend to be heavy, bulky and are not easily transportable unless they are being worn. Although civilians (or other non-military or non-police persons) have the ability to purchase such protective vests for their own safety, these individuals rarely choose to do so because it is impractical for them to carry and/or wear the protective vests on a regular basis. As a result, these individuals are typically left unprotected in the event that they are caught in an active shooter situation or other dangerous situation (e.g., such as a mass casualty incident).

In recent years, the number of active shooter situations has dramatically increased throughout the United States and other parts of the world. Many of these active shooter situations are the result of foreign and/or local terrorist activities. With the goal of inflicting as many casualties as possible, active shooters often select a "soft target" (e.g., such as a school, a stadium or airport) which is populated with unarmed and/or unprotected civilians. Civilians caught in these situations often have no way to protect themselves.

In view of the foregoing, there is a need for providing individuals with a practical means of transporting and deploying protection vests that can be used for protection in active shooter situations and other dangerous situations.

SUMMARY

The present disclosure relates to bags and other carriers that can be transformed into protective vests which can serve as body armor and/or ballistic shields, and which are equipped with additional tools that are useful in dangerous situations. The carriers can be arranged, assembled and deployed in a first configuration which permits items to be stored and transported within the carriers when the carriers are not being used as protective vests. In the event of an active shooter situation or other dangerous situation, the carriers can be quickly and easily converted to or deployed in a second configuration that allows the carriers to be used as protective vests. The carriers include fasteners which can be disengaged to separate the carriers into front vest portions and rear vest portions. The interiors of the carriers include connectors for reassembling the front vest portions and rear vest portions to create protective vests. When the protective vests are being worn, items included within storage compartments of the carriers are able to provide additional defensive barriers against projectiles or other threats. Shoulder straps attached to the carriers can be detached. The shoulder straps may include built-in tourniquets, and/or loop assemblies that can be utilized to secure a door in a closed position or drag an injured victim to safety.

In accordance with certain embodiments, a backpack is configured to be transformed into a protective vest. The backpack includes a compartment that houses one or more connectors and a fastener that is configured to at least partially seal the compartment. Full disengagement of the fastener enables a complete separation of the backpack into at least two disconnected portions including a front vest portion and a rear vest portion. The one or more connectors enable the front vest portion to be coupled to the rear vest portion such that the backpack is reconfigured as a protective vest. At least one armor component that is incorporated into the front vest portion or the rear vest portion.

In accordance with certain embodiments, a carrier is configured to be transformed into a vest. The carrier includes a compartment formed within two portions that are coupled together by a fastener which provides access to the compartment. At least one armor component is incorporated into one or the two portions and disengagement of the fastener enables a complete separation of the two portions from each other. One or more connectors included on interior walls of the compartment enable the two portions to be coupled together so as to form a vest.

In accordance with certain embodiments, a method is disclosed for providing a carrier that can be transformed into a protective vest. The method includes the step of providing a carrier that includes a compartment that houses one or more connectors. A fastener provides access to the compartment and disengagement of the fastener enables a complete separation of the carrier into two disconnected portions including a front vest portion and a rear vest portion. Coupling the front and rear vest portions together through the one or more connectors around an individual's body enables the carrier to be reassembled as a vest. At least one armor component is incorporated into the front vest portion or the rear vest portion.

These and other features and advantages will become apparent from the following detailed description of illustrative embodiments thereof, which is to be read in connection with the accompanying drawings.

BRIEF DESCRIPTION OF DRAWINGS

The inventive principles are illustrated in the figures of the accompanying drawings which are meant to be exemplary and not limiting, in which like references are intended to refer to like or corresponding parts, and in which.

DETAILED DESCRIPTION OF EXEMPLARY EMBODIMENTS

Figure 1:
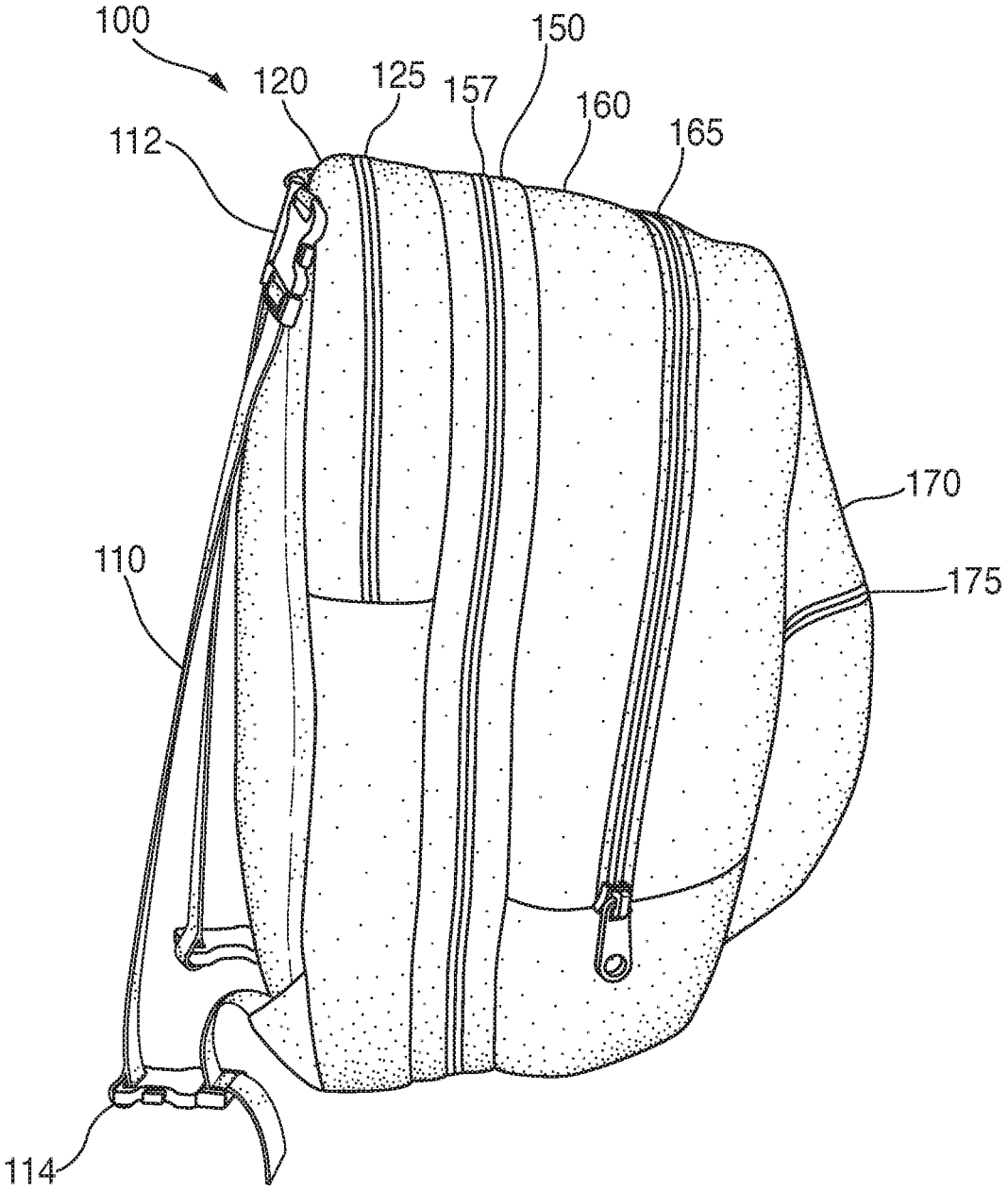
FIG. 1 is a side view of a carrier in accordance with certain embodiments of the present invention.

The present disclosure relates to bags and other types of carriers that can be transformed into protective vests which may be used as body armor and ballistic shields. In a first configuration, the carriers are arranged to store and transport items (e.g., arranged as a backpack, bag or case that allows for transporting items). When a threat is imminent, the carriers can quickly and easily be converted to or deployed in a second configuration that serves as a protective vest which can be worn as body armor to provide protection from projectiles and other threats.

The carriers may be separated into two distinct pieces or portions: a front vest portion and a rear vest portion. When a carrier is not being utilized as a protective vest, a fastener joins or connects the front vest portion with the rear vest portion. The front vest portion and a rear vest portion may be connected using any type of fastener including, but not limited to, zippers, hook and loop connectors (e.g., Velcro®), snap connectors, buttons, quick release snaps, magnets, sleeve connectors, buckle connectors, pull cord connectors (e.g., which separate when the cord is pulled) and/or any other type of connector. In the event that an individual wishes to transform the carrier to be used as body armor, the individual can disengage the fastener to disconnect or separate the front vest portion of the bag from the rear vest portion of the bag. The front vest portion and rear vest portion can then be reassembled and connected to create a wearable protective vest. The carriers can be reassembled as protective vests using connectors located within a central compartment of the carrier.

The carriers may be equipped or integrated with one or more armor components. In certain embodiments, the carriers include a frontal armor component (e.g., which may be located in the front vest portion) which is intended to protect an individual's chest and frontal regions when the carrier is worn as a vest, as well as a rear armor component (e.g., which may be located in the rear vest portion) which is intended to protect the individual's back and posterior regions when the carrier is worn as a vest. The carriers may additionally include armor components to protect the individual's side regions or other regions of the individual's body. The armor portions may be composed of, or include, any plated or non-plated armor material. Exemplary materials that may be incorporated into the armor components may include any of the following materials either alone or in combination: metals (e.g., steel, iron, and titanium), plastics (e.g., polyethylene), high-strength fibers (e.g., Kevlar®, aramid or para-aramid fibers, and hydrocarbon fibers) and/or any other materials that can provide protection against projectiles or the like. The armor components may be permanently integrated into the carriers and/or may be removable to allow for replacement or upgrading.

The outer housing of the carriers may be constructed of any appropriate material. In certain embodiments, the housing may be constructed of any type of textile, cloth or fabric including, but not limited to, nylon, cotton, polyester, wool, leather or canvas. In certain embodiments, the housing may alternatively, or additionally, be constructed of or include rigid materials such as plastics, wood or metal materials. In certain embodiments, the housing may alternatively, or additionally, be constructed of or include armor materials including, but not limited to, any plated or non-plated armor materials.

Some or all portions of the carriers may be water resistant. In certain embodiments, a carrier may include sections or compartments (e.g., located in or near the interior walls of a central compartment in the bag) that house metal or plated armor components and the sections or compartments may be configured to be water resistant to prevent damage to armor components in the event that the carrier is submerged or otherwise subjected to liquids. In certain embodiments, the outer housing of the carrier may additionally, or alternatively, be water resistant.

In certain embodiments, each carrier may include one or more storage compartments for holding or transporting items. The size of the compartments may vary depending upon the type of carrier. The storage compartments may be sealed or closed using any of the aforementioned fasteners or any other type of fastener. When the carrier is converted to a vest, any items included within the compartments may be retained therein in order to provide additional protection against projectiles or the like.

Each carrier may further include a compartment that houses connectors for reassembling the carrier into a protective vest. Specifically, when the front vest portion and rear vest portion of the carrier are joined with the fastener, a compartment is formed between the front vest portion and rear vest portion. A pair of shoulder straps and a pair of mid-section connectors are stored within the compartment. The shoulder straps and mid-section connectors may be attached to and integrated with the interior walls of the compartment (e.g., on surfaces of the front vest portion and/or rear vest portion). The shoulder straps and mid-section connectors are exposed or made accessible after the carrier is separated. The separated portions can then be assembled into a protective vest by connecting the front vest portion and rear vest portion with the shoulder straps and mid-section connectors. The shoulder straps and mid-section connectors can be adjusted to accommodate the height and weight of the individual wearing the vest.

In addition to the shoulder straps that are included within the compartment to enable assembly of the protective vest, the exterior of a carrier may include one or more straps that assist an individual with transporting the carrier when it is not being utilized as a protective vest. For instance, a backpack carrier may include a pair of shoulder straps to enable an individual to carry the backpack on his or her back. Likewise, a handbag carrier (e.g., a satchel or purse) may include a shoulder strap(s) that enables the individual to rest the handbag atop his or her shoulder.

In certain embodiments, one or more of these exterior straps may be detached from the carrier and may include a built-in tourniquet and/or built-in loop assembly. In the event of an active shooter or other dangerous situation, a strap having the built-in tourniquet may be detached from the carrier to assist injured persons. Likewise, a strap having a built-in loop assembly may be detached from the carrier and utilized to secure a door handle in order to prevent entry through a doorway, or as a tether that can assist an individual with dragging injured victims.

Each of the carriers may further include one or more handles. The handles may be located on a top portion, or any other portion, of the carriers. The handles may be used to carry the carrier when it is being utilized to transport items. The handle(s) may be detachable from the carrier and may be configured to be utilized as a door stop (e.g., which can be wedged beneath a door to prevent entry through the door)

or other types of tools (e.g. such sleeve that houses a rechargeable battery pack, gauze, additional tourniquets, etc.).

In certain embodiments, the carriers may include armor components that can protect additional regions of an individual's body besides the torso region. For example, when configured as a protective vest, the carriers may include an extension or flap that extends down and covers an individual's groin, legs, buttocks or other region. The extension or flap may include an armor component which can protect the individual's groin, femoral arteries and/or other regions.

In certain embodiments, additional protection measures may be incorporated into any of the carriers described herein. For example, in certain embodiments, the carriers may be equipped with one or more weapons (e.g., guns, knives, pepper sprays or mace) and/or holsters for carrying the one or more weapons or items (e.g., flashlights).

While certain portions of this disclosure may describe an application of the self-defense technologies and inventive principles in connection with backpacks, the scope of the invention is not limited to such embodiments. Rather, the technologies and principles disclosed herein can be applied to any type of carrier or the like, including, but not limited to, any and all handbags, duffle bags, beach bags, satchels, purses, briefcases, luggage items, travel bags, tote bags, shoulder bags, laptop bags, wheeled or rolling bags, messenger bags, suitcases, technical packs, and transport containers.

The carriers disclosed herein may be separated into two portions along a fastener that extends vertically, horizontally or diagonally with respect to the carrier. For example, when a carrier is situated in an upright position, a fastener may extend vertically or horizontally around the carrier. The carrier can then be detached into two separate pieces along the fastener (e.g., into separate top and bottom pieces or into separate left and right pieces). Thus, regardless of where the fastener is situated, it may allow for a separation of the carrier.

It should be noted that the protective vests can be configured to be worn in a reversible fashion. For example, both the front and rear vest portions can be equipped against either side of an individual (i.e., either the individual's front side or an individual's rear side). The terms "front" and "rear" are not intended to be limiting and are intended to be used interchangeably.

In certain embodiments, an individual may download an application on a computing device (e.g., mobile phone, desktop computer, tablet, smart watch or other computing device) and/or access a website which provides useful information and functions that can provide assistance to the individuals who are involved in an active shooter situation or other type of dangerous situation. The application and/or website may provide training assistance for utilizing a carrier that incorporates the technology described herein. For example, the application and website may provide instructions for converting the carrier into a protective vest, or vice versa. The application and/or website may also provide functions that assist the individual during an active shooter incident or other type of threat. For example, the application and website may permit the individual to transmit a request for first aid, or to notify police or others of on-going active shooter incidents or other potential threats.

The carriers described in this disclosure can be manufactured using any suitable technique. The various components of the carriers (e.g., the housing, armor portions, straps, etc.) can be constructed using different manufacturing techniques, and the components can then be combined and assembled to create the carriers. Exemplary techniques that may be utilized to manufacture the carriers or its components include any or all of the following: knitting and weaving techniques, molding techniques (e.g., blow molding, injection molding or compression molding techniques), casting techniques (e.g., in which liquid material is poured into a mold), 3D-printing or additive manufacturing techniques, and machining techniques (e.g., in which a piece of material is cut into a desired final shape and size).

The inventive principles discussed herein provide a variety of advantages. Importantly, carriers are provided that serve dual functions associated with transporting items and self-defense. The armor components of the protective vest serve to protect the individuals' vital organs from bullets, shrapnel, knives and other threats. Thus, individuals that find themselves caught in an active shooter situation, or other types of dangerous situations, are provided with self-defense capabilities to increase their chances of survival and decrease their chances of injury. Moreover, while many civilians and other individuals are not willing to wear or carry conventional protective vests on a regular basis (e.g., because they tend to be bulky and are not easy to transport), the present solution permits commonly used carriers to be transformed into protective vests when needed, thus making it practical for these individuals to carry protective vests on their persons. In addition, the design and configuration of the carriers allows for a quick and easy conversion into protective vests. This is important given that an individual may only have a limited amount of time to protect themselves in the event of an active shooter situation or other dangerous situation. In addition to providing body armor, the detachable straps of the bags are designed to assist injured victims, either as a tourniquet that can restrict blood circulation or as a dragging device that can assist with removing victims from dangerous locations. The designs of the straps further enable individuals to secure a door in a closed position, thereby preventing entry of an active shooter or other dangerous individuals into protected areas. These and other advantages should be apparent from the disclosure herein.

It should be recognized that the embodiments described in this disclosure can be combined in various ways. Any aspect or feature that is described in connection with one embodiment can be incorporated into any other embodiment mentioned in this disclosure.

Referring now to the drawings in which like numerals represent the same or similar elements and initially to FIG. 1, an exemplary backpack carrier 100 is disclosed that can be transformed into a protective vest. Several storage compartments 120, 160 and 170 are incorporated into the housing of the backpack 100 for carrying and transporting items. The storage compartments 120, 160 and 170 extend the vertical length of the backpack 100. The storage compartments can be sealed or unsealed with corresponding fasteners 125, 165 and 175. In this exemplary embodiment, the fasteners 125, 165 and 175 are zippers. Other types of fasteners may also be utilized (e.g., such as hook and loop connectors, snap connectors, buttons, quick release snaps, magnets, sleeve connectors, pull cord connectors).

The backpack 100 further includes a pair of external shoulder straps 110 which permit an individual to carry or transport the backpack 100, along with any items included therein, on his or her back. Each external shoulder strap 110 includes an upper connector 112 and a lower connector 114 which are utilized to couple the strap 110 to the backpack 100. In this exemplary embodiment, the upper and lower connectors 112, 114 are buckle connectors that include corresponding male and female mating portions. However, any of the aforementioned fasteners (e.g., snap connectors, hook and loop connectors, button connectors, etc.), or other types of fasteners, can alternatively or additionally be utilized to couple the straps 110 to the backpack 100. The external shoulder straps 110 can be detached from the backpack 100 by disengaging the connectors 112, 114. As explained in further detail below, the detached shoulder straps 110 are designed to be utilized as tourniquets (e.g., for restricting blood circulation) and/or loop assemblies (e.g., for dragging injured persons or securing doors).

The backpack 100 includes another fastener 157 located near a central, vertical axis of the backpack 100. The fastener 157 provides access to a central compartment 150 and enables the backpack 100 to be detached into two separate portions, namely, a front vest portion and a rear vest portion. Connection components located on the interior walls of the compartment 150 can be used to reassemble the backpack 100 into a protective vest that can be worn as body armor or a ballistic shield. In this exemplary embodiment, the fastener 150 is a zipper. However, any of the aforementioned fasteners, or other types of fasteners, can alternatively or additionally be utilized to connect the portions of the backpack 100.

Figure 2:
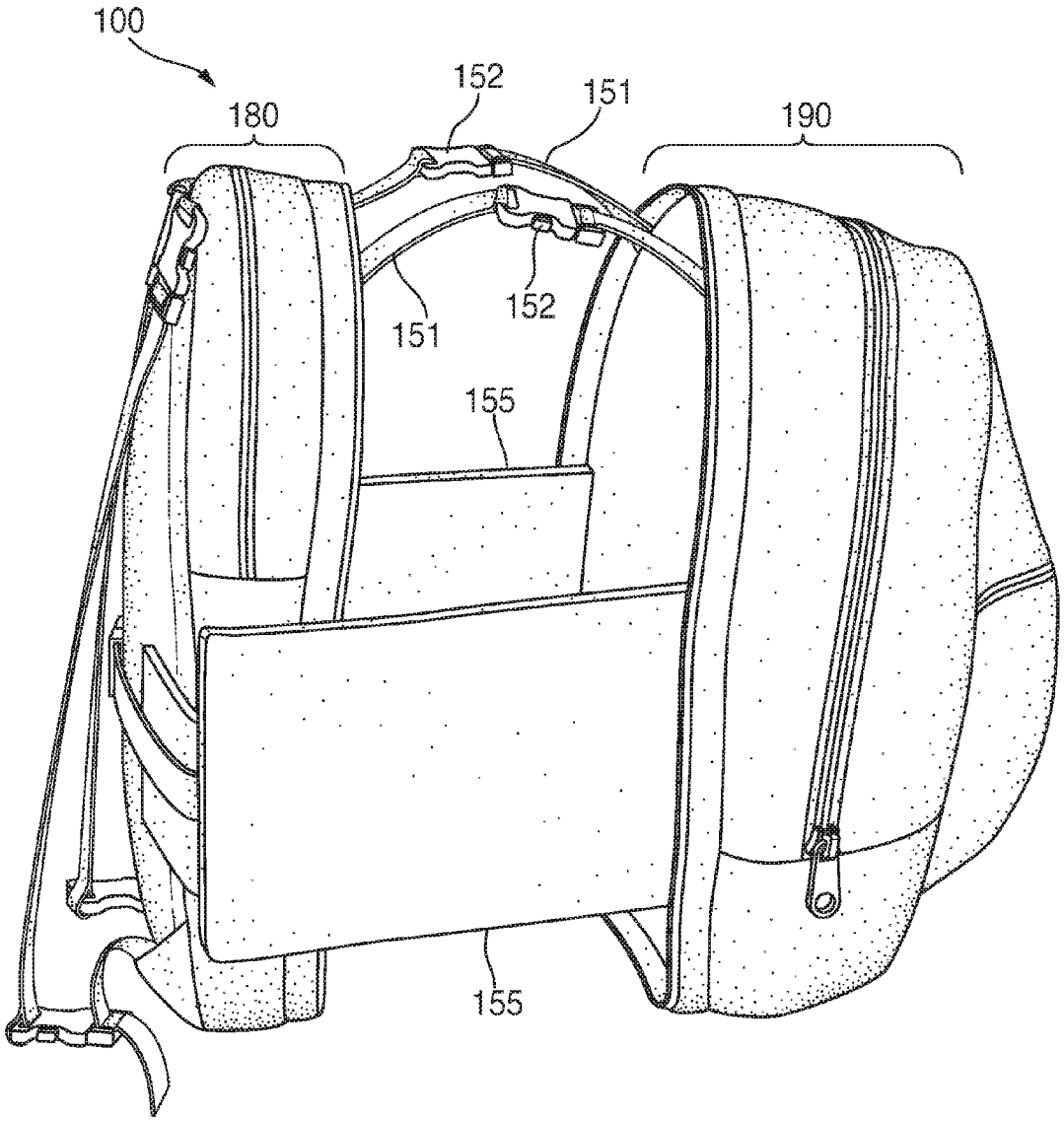
FIG. 2 is a side view of a carrier that is arranged as a protective vest in accordance with certain embodiments of the present invention.
Figure 3:
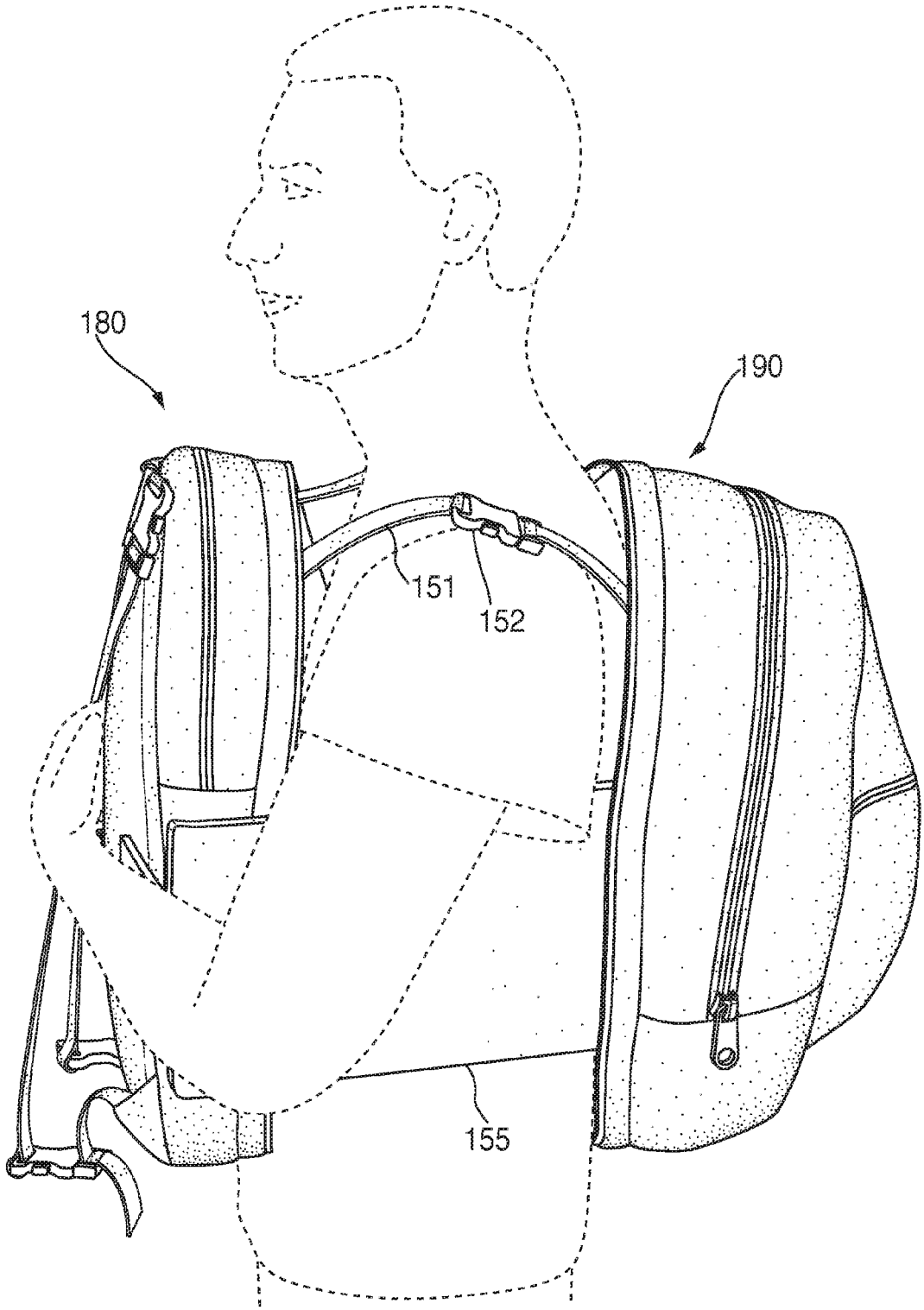
FIG. 3 is a side view of an individual wearing a carrier that is arranged as a protective vest in accordance with certain embodiments of the present invention.

FIGS. 2 and 3 illustrate a side view of the backpack 100 when it is assembled as a protective vest. In these figures, the fastener 157 is disengaged, thus separating the backpack into a front vest portion 180 and a rear vest portion 190. The connection components included within the central compartment 150 are utilized to connect the front vest portion 180 and the rear vest portion 190 in a configuration that can be worn as a protective vest.

In this exemplary embodiment, the connection components stored within the central compartment 150 include a pair of internal shoulder straps 151 and a pair of mid-section connectors 155. The connection components are preferably configured in a manner that can be adjusted to accommodate individuals of different sizes, heights and weights. Each of the shoulder straps 151 are attached to the interior surfaces of the front vest portion 180 and the rear vest portion 190, and include a separable buckle fastener 152. Again, any of the aforementioned fasteners, or other types of fasteners, can alternatively or additionally be incorporated into the interior shoulder straps 151.

The mid-section connectors 155 are attached to the interior surface of the rear vest portion 190. Each mid-section connector 155 includes a flap portion that can pivot horizontally and outwardly from the center of the surface. The ends of the mid-section connectors 155 include fasteners for coupling the mid-section connectors 155 to the front vest portion 180 and for securing the vest to an individual's body. For example, in this embodiment, the end of each mid-section connector 155 includes a piece of flexible material that can bend around the exterior surface of the front vest portion 180 and a hook and loop connector (e.g., Velcro® connector) which can be coupled to a corresponding hook and loop connector located on the exterior surface. Each strap may further include a corresponding portion of a buckle connection that can be coupled together. Again, any of the aforementioned fasteners, or other types of fasteners, can alternatively or additionally be incorporated into the mid-section connectors 155. The mid-section connectors 155 may connect the front vest portion 180 and rear vest portion 190 in other ways as well. For example, in certain embodiments, the mid-section connectors 155 may attach to an interior portion of the front vest portion 180 (e.g., to an interior surface of the central compartment 150 located on the front vest portion 180).

The front vest portion 180 and the rear vest portion 190 include armor components which can protect an individual's torso and back. In certain embodiments, the mid-section connectors 155 may also include armor components to protect an individual's side areas. The armor components incorporated into the front vest portion 180, rear vest portion 190 and/or mid-section connectors 155 may include any type of plated or non-plated armor. In certain embodiments, the armor components are removable and can be upgraded by the individual.

Figure 4B:
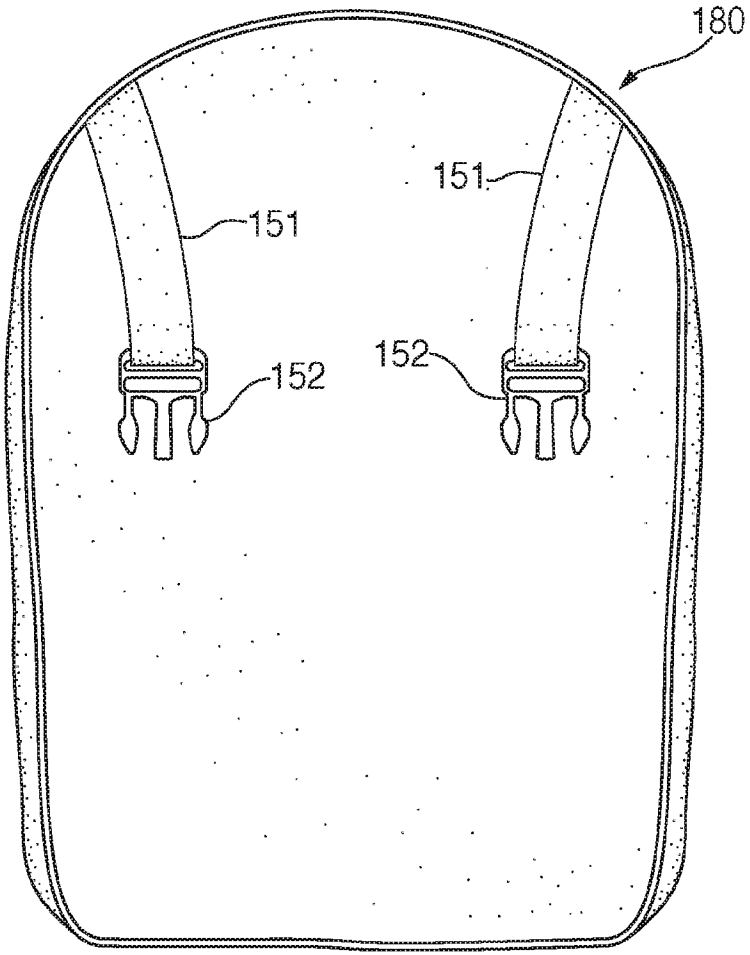
FIGS. 4A and 4B illustrate an interior arrangement of an exemplary carrier in accordance with certain embodiments of the present invention.
Figure 4A:
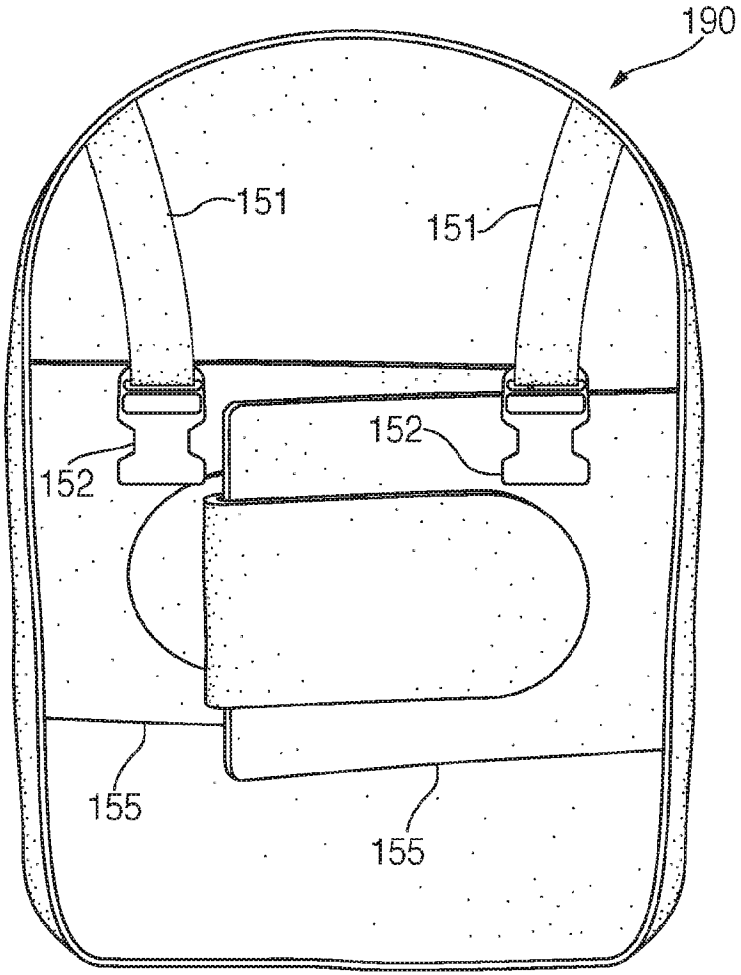

FIGS. 4A and 4B illustrate the interior of the central compartment 150 of the backpack 100 when the backpack 100 is separated along the fastener 157. Specifically, FIG. 4A illustrates an interior surface of the compartment 150 which is attached to the rear vest portion 190 and FIG. 4B illustrates an interior surface of the compartment 150 which is attached to the front vest portion 180. In certain embodiments, the armor components are incorporated into these interior surfaces and/or are located immediately adjacent and behind these surfaces. For example, metal armored plates (e.g., which may be made of steel or other metals) may be located behind the interior surfaces of the front and rear vest portions, or inserted into sleeves that are included on the surfaces. Likewise, soft armor components (e.g., Kevlar® or other high-strength fibers) may be integrated directly into the interior surfaces or included in sleeves that are located on the surfaces. The armor components may alternatively, or additionally, be incorporated into other portions of the front vest portion 180 and rear vest portion 190.

The surface of the rear vest portion 190 is attached to the mid-section connectors 155 and the female portion of the shoulder strap connector 152. The surface of the front vest portion 180 is attached to the male portion of the shoulder strap connector 152. The male and female portions of the shoulder strap connectors 152 can be coupled together to enable the vest to be worn on the shoulders of an individual. The mid-section connectors 150 may extend around and couple to an exterior portion of the front vest portion 180.

Figure 5:
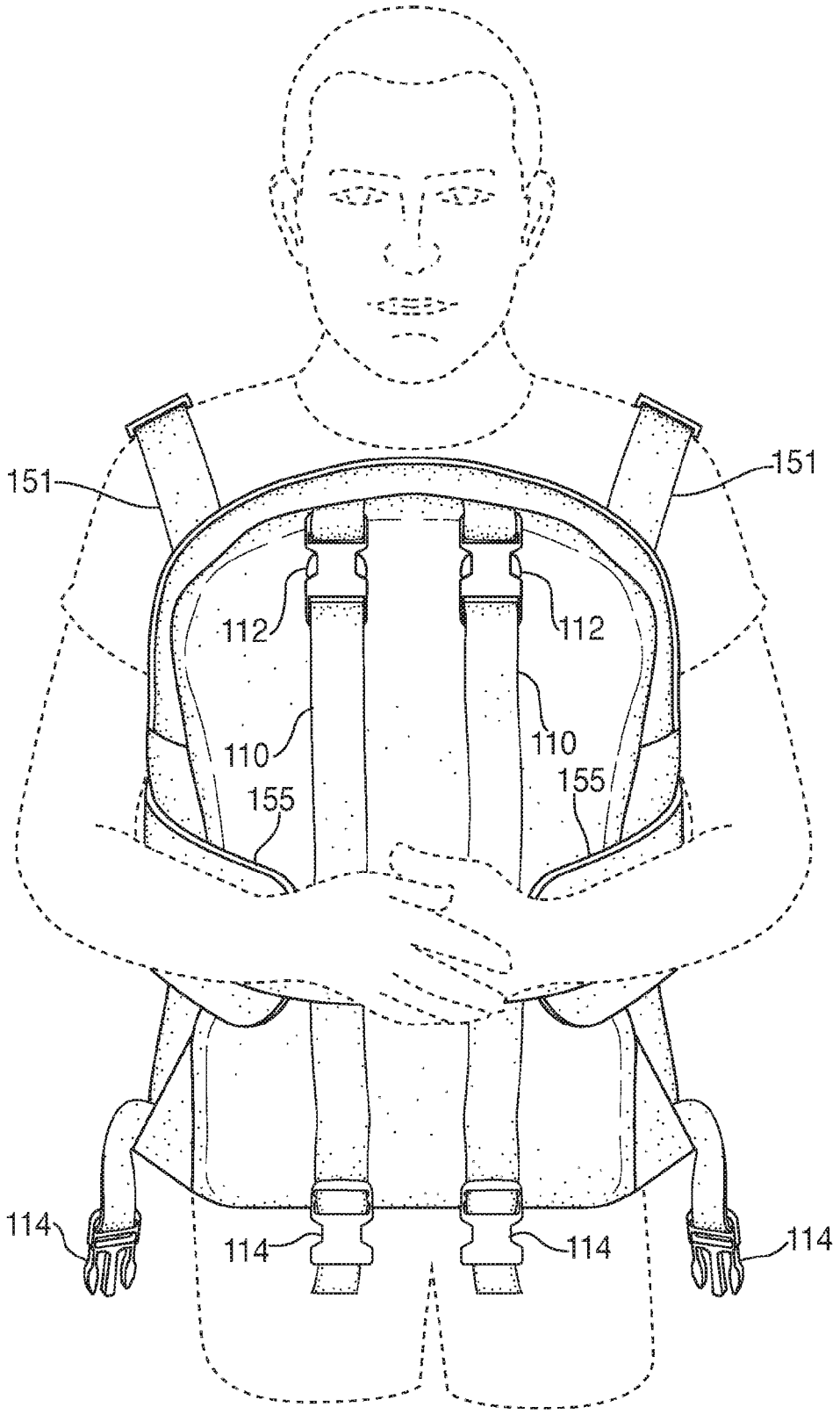
FIG. 5 is a front view of an individual wearing a carrier that is arranged as a protective vest in accordance with certain embodiments of the present invention.

FIG. 5 is a front view of an individual wearing a backpack 100 that is arranged as a protective vest in accordance with certain embodiments of the present invention. As mentioned above, the protective vest can be worn in either direction (e.g., with vest portion 180 secured to the individual's front or back). The front vest portion 180 may be outfitted with one or more armor portions to protect the individual from projectiles and other threats. Items included in a front compartment 120 may provide additional protection against projectiles and other threats. Items included in the rear compartments 160, 170 may similarly provide additional protection.

The front vest portion 180 includes two external shoulder straps 110. The external shoulder straps 110 are detachable via the connectors 112 and 114. In certain embodiments, one or more of the external shoulder straps 110 may be configured as a tourniquet that can be utilized as a constricting band to control bleeding. For example, a connector 112, 114 (e.g., a buckle connector) may enable a detached shoulder strap 110 to be arranged in a loop or ring that can be placed around an arm or leg of an injured individual. The size of the loop or ring can then be adjusted or tightened to restrict the individual's blood flow. The connector may be configured to lock the size of the loop or ring when it is in a tightened position. In certain embodiments, the strap 110 or other portion of the backpack 100 may further include a stick, handle or ratchet-like device that can be utilized to turn and tighten the loop or ring. The strap 110 may include a small ring or sleeve for receiving the device and which enables the device to tighten the tourniquet.

One or more of the external shoulder straps 110 may also be configured as a looping assembly that can be utilized to drag victims to safety, to secure doors, and/or for other functions. In certain embodiments, a connector 112, 114 (e.g., a buckle connector) may enable a detached shoulder strap 110 to be arranged in a loop or ring that can be placed around a door handle and tightened around the handle. An opposite end of the shoulder strap 110 may then be tethered or attached to a fixed or stationary structure. The length of the strap between the structure and the door handle can be adjusted appropriately at one or more of the connectors 112, 114 to secure the door in a closed position.

The looping assemblies formed from the external shoulder straps 110 may also be utilized to drag injured individuals or other individuals. In certain embodiments, a connector 112, 114 (e.g., a buckle connector) may enable a detached shoulder strap 110 to be arranged in a loop or ring that can be placed around an individual's limb, wrist or ankle. The loop or ring may be arranged at the one end of the strap 110 and may be connected to a portion of the strap 110 which can be used to pull the individual to safety in the event of an active shooter situation or other dangerous situation.

Figure 6:
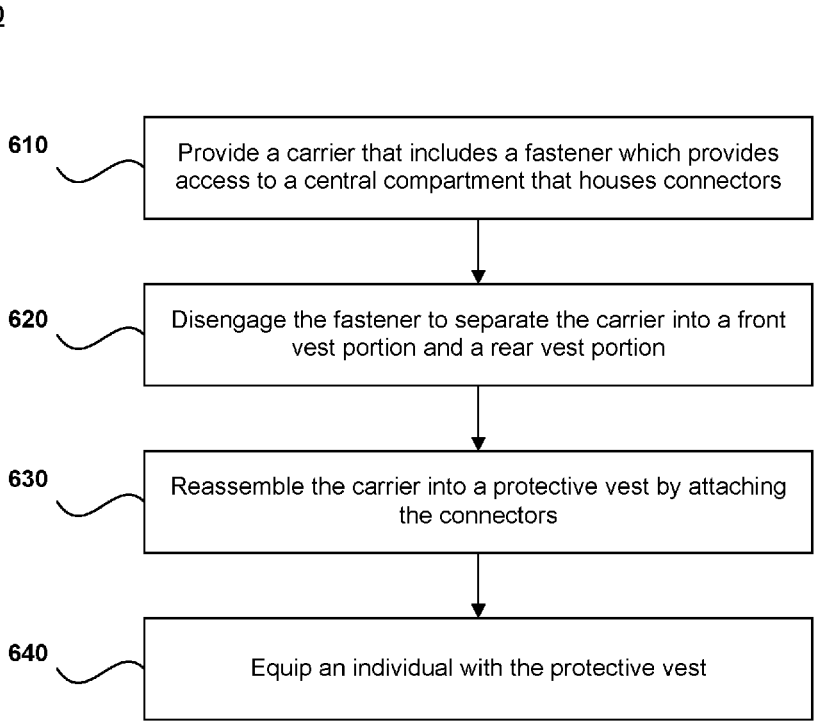
FIG. 6 is a flow diagram of a method for transforming a carrier into a protective vest in accordance with certain embodiments of the present invention.

FIG. 6 is a flow diagram of a method 600 for transforming a carrier into a protective vest in accordance with certain embodiments of the present invention. A carrier is provided which includes a fastener 157 which provides access to a central compartment 150 which houses connectors (step 610). The step of providing a carrier may include generating, fabricating, manufacturing, creating, or utilizing the carrier. The carrier may represent any bag, case or container including any of those mentioned above. The front vest portion 180 and a rear vest portion 190 may be connected using any type of fastener, e.g., such as a zipper, hook and loop connectors, snap connectors, buttons, etc. Next, the fastener 157 is disengaged to separate the carrier into a front vest portion 180 and a rear vest portion 190 (step 620). Separating the carrier along the fastener 157 permits the connectors to be accessed. The carrier is reassembled into a protective vest by attaching the connectors (step 630). Exemplary connectors may include a pair of shoulder straps 151 and a pair of mid-section connectors 155. An individual may then be equipped with the protective vest (step 640). For example, an individual may equip the vest by placing the individual's head between the shoulder straps 151, resting the shoulder straps 151 on the individual's shoulders, and securing the vest to the individual's body using the mid-section connectors 155.

It should be recognized that numerous variations can be made to the above-described systems and methods without departing from the scope of the invention.

While various novel features of the invention have been shown, described and pointed out as applied to particular embodiments thereof, it should be understood that various omissions and substitutions and changes in the form and details of the systems and methods described and illustrated, may be made by those skilled in the art without departing from the spirit of the invention. Amongst other things, the steps shown in the methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the particular system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation.

What is claimed is:

1. A backpack that is configured to be transformed into a protective vest, the backpack comprising:

a backpack housing that is configured to be assembled as a backpack carrier in a first configuration and a protective vest in a second configuration, wherein, when converting from the first configuration to the second configuration, the backpack housing can be completely separated into two disconnected portions such that there are no direct or indirect structures connecting the portions;

wherein the backpack housing assembled in the first configuration defines an internal cavity which is segmented by interior walls into a plurality of compartments including at least (i) a first storage compartment, (ii) a second storage compartment and (iii) a central compartment that houses one or more connectors, the central compartment being disposed between the first and second compartments;

a fastener that is configured to at least partially seal the central compartment when assembled in the first configuration, wherein full disengagement of the fastener enables a complete separation of the backpack into the two disconnected portions including a front vest portion comprising the first storage compartment and a rear vest portion comprising the second storage compartment, and wherein the one or more connectors enable the front vest portion to be coupled to the rear vest portion such that the backpack is reconfigured as the protective vest in the second configuration; and at least one armor component that is incorporated into one or more sleeves disposed in one or more of the interior walls of the backpack housing such that at least one of the front vest portion and the rear vest portion includes the at least one armor component.

2. The backpack of claim 1, further comprising at least one detachable shoulder strap that includes a built-in tourniquet or a built-in loop assembly configured to provide assistance with dragging an individual or securing a door in a closed position.

3. The backpack of claim 2, wherein the at least one shoulder strap includes a first connector located at one end of the shoulder strap and a second connector located at an opposite end;

wherein the at least one shoulder strap can be disconnected from the backpack by disengaging the first and second connectors; and wherein the first connector and second connector permit the at least one strap to be arranged in a loop or a ring that can be utilized as the tourniquet or loop assembly.

4. The backpack of claim 3, wherein the first and second connectors include corresponding mating connectors that are configured to engage one another to permit the at least one strap to be arranged in the loop or ring.

5. The backpack of claim 1, wherein the interior walls include a first shared wall located between the first storage compartment and the central compartment and a second shared wall located between the second storage compartment and the central compartment; and wherein the at least one armor component is integrated into the one or more sleeves located on the first or second shared wall.

6. The backpack of claim 1, wherein a structure of the internal cavity permits content included within the first and second storage compartments to remain within the first and second storage compartments when the backpack is arranged as a protective vest in the second configuration; and wherein, when the backpack is separated and reconfigured as the protective vest around an individual's body, any content included in the first and second storage compartments provides an outer defensive barrier against projectiles or other threats and the at least one armor component provides an inner defensive barrier.

7. The backpack of claim 1, wherein the connectors included in the central compartment comprise:

a pair of mid-section connectors configured to connect the front vest portion to the rear vest portion near an individual's mid-section region; and a pair of shoulder straps which are attached to interior walls of the central compartment.

8. The backpack of claim 7, wherein each of the shoulder straps includes a first strap portion that is attached to an interior wall of the front vest portion, a second strap portion that is attached to an interior wall of the rear vest portion, and a strap fastener for connecting the first and second strap portions.

9. The backpack of claim 7, wherein the mid-section connectors include additional armor components to protect the individual's side regions.

10. A carrier that is configured to be transformed into a protective vest, the carrier comprising:

a housing that is configured to be assembled as a carrier in a first configuration and a protective vest in a second configuration, wherein, when converting from the first configuration to the second configuration, the housing can be completely separated into two disconnected portions such that there are no direct or indirect structures connecting the portions;

wherein the housing assembled in the first configuration defines an internal cavity which is segmented by interior walls into a plurality of compartments including at least (i) a first storage compartment, (ii) a second storage compartment and (iii) a central compartment formed within two portions that are coupled together by a fastener which provides access to the central compartment;

wherein a fastener that is configured to at least partially seal the central compartment when assembled in the first configuration, wherein full disengagement of the fastener enables a complete separation of the carrier into the two disconnected portions including a front vest portion comprising the first storage compartment and a rear vest portion comprising the second storage compartment;

wherein at least one armor component is incorporated into one or more sleeves disposed in one or more of the interior walls of the backpack housing such that at least one of the front vest portion and the rear vest portion includes the at least one armor component;

wherein one or more connectors included on the interior walls that enable the two portions to be coupled together so as to form protective vest.

11. The carrier of claim 10, further comprising at least one detachable strap that includes a built-in tourniquet or a built-in loop assembly configured to provide assistance with dragging an individual or securing a door in a closed position.

12. The carrier of claim 11, wherein the at least one strap includes a first connector located at one end of the strap and a second connector located at an opposite end;

wherein the at least one strap can be disconnected from the backpack by disengaging the first and second connectors; and wherein the first connector and second connector permit the at least one strap to be arranged in a loop or a ring that can be utilized as the tourniquet or loop assembly.

13. The carrier of claim 12, wherein the first and second connectors include corresponding mating connectors that are configured to engage one another to permit the at least one strap to be arranged in the loop or ring.

14. The carrier of claim 10, wherein the interior walls include a first shared wall located between a first storage compartment and the central compartment; and wherein a second shared wall located between a second storage compartment and the central compartment; and wherein the at least one armor component is integrated into the first or second shared wall.

15. The carrier of claim 14, wherein a structure of the internal cavity permits content included within the first and second storage compartments to remain within the first and second storage compartments when the backpack is arranged as a protective vest in the second configuration; and wherein any content included in the first and second storage compartments provides an outer defensive barrier against projectiles or other threats and the at least one armor component provides an inner defensive barrier.

16. The carrier of claim 10, wherein the connectors included in the central compartment comprise:

one or more mid-section connectors configured to connect the separated two portions together near an individual's mid-section region; and a pair of shoulder straps attached to interior walls of the central compartment.

17. The carrier of claim 16, wherein each of the shoulder straps includes a first strap portion that is attached to an interior wall of one of said two portions, a second strap portion that is attached to an interior wall of the other of said two portions, and a strap fastener for connecting the first and second strap portions.

18. The carrier of claim 16, wherein the one or more mid-section connectors include at least one additional armor component.

19. A method for providing a carrier that can be transformed into a protective vest, the method comprising:

providing a carrier that includes one or more connectors, wherein:

a housing is configured to be assembled as a backpack carrier in a first configuration and a protective vest in a second configuration, wherein the housing assembled in the first configuration defines an internal cavity which is segmented by interior walls into a plurality of compartments including at least (i) a first storage compartment, (ii) a second storage compartment and (iii) a central compartment, the central compartment being disposed between the first and second compartments;

a fastener provides access to the central compartment;

disengagement of the fastener enables a complete separation of the carrier into two disconnected portions such that there are no direct or indirect structures connecting the portions including a front vest portion comprising the first storage compartment and a rear vest portion comprising the second storage compartment;

coupling the front and rear vest portions together through the one or more connectors around an individual's body enables the carrier to be reassembled as a protective vest in the second configuration;

at least one armor component is incorporated into one or more sleeves disposed in one or more of the interior walls of the backpack housing such that at least one of the front vest portion and the rear vest portion includes the at least one armor component.

20. The method of claim 19, further comprising fabricating the carrier utilizing one or more manufacturing techniques.

* * * * *